United States Patent [19]

Merzenich

[11] 4,006,855

[45] Feb. 8, 1977

[54] SEPARATOR WORM FEED AUGER AND WEAR PLATES

[75] Inventor: Konrad Merzenich, Hoffnungsthal, Germany

[73] Assignee: Klockner-Humboldt-Deutz Aktiengesellschaft, Germany

[22] Filed: Oct. 23, 1975

[21] Appl. No.: 625,032

[30] Foreign Application Priority Data

Oct. 23, 1975 Germany ..... 2450337

[52] U.S. Cl. ..... 233/7; 416/224

[51] Int. Cl.[2] ..... B04B 3/04

[58] Field of Search ..... 233/7, 27; 415/197, 415/72, 121 B; 416/218, 220, 221, 224, 135

[56] References Cited

UNITED STATES PATENTS

| | | | |
|---|---|---|---|
| 952,317 | 3/1910 | Eyermann | 416/135 |
| 1,142,916 | 6/1915 | Scott | 416/224 |
| 1,347,031 | 7/1920 | Guy | 416/220 R |
| 3,313,519 | 4/1967 | Jenson | 416/221 |
| 3,764,062 | 10/1973 | Brautigam | 233/7 |
| 3,768,996 | 1/1974 | Richter | 415/121 B |

FOREIGN PATENTS OR APPLICATIONS

| | | | |
|---|---|---|---|
| 250,728 | 7/1948 | Switzerland | 416/221 |

*Primary Examiner*—George H. Krizmanich
*Attorney, Agent, or Firm*—Hill, Gross, Simpson, Van Santen, Steadman, Chiara & Simpson

[57] ABSTRACT

A centrifugal separator having a rotating chamber with a material advancing structure within the chamber including a spirally shaped carrier vane arranged coaxially within the chamber and supported on a rotatable driving shaft driven in rotation at a speed different than the chamber with a spirally shaped wear plate supported on the vane having an outer edge radially outwardly of the vane with a mounting face extending radially alongside a radial face of the carrier vane and a mounting piece secured to the mounting face of the carrier vane with means securing the wear plate to the mounting piece such as bevelled radially facing circumferentially extending interlock surfaces between a channel of the wear plate and the mounting piece and a tangentially or circumferentially inserted locking element extending between the radial outer surface of the mounting piece or the carrier vane for carrying the wear plate so that it will not tilt on the carrier vane.

11 Claims, 6 Drawing Figures

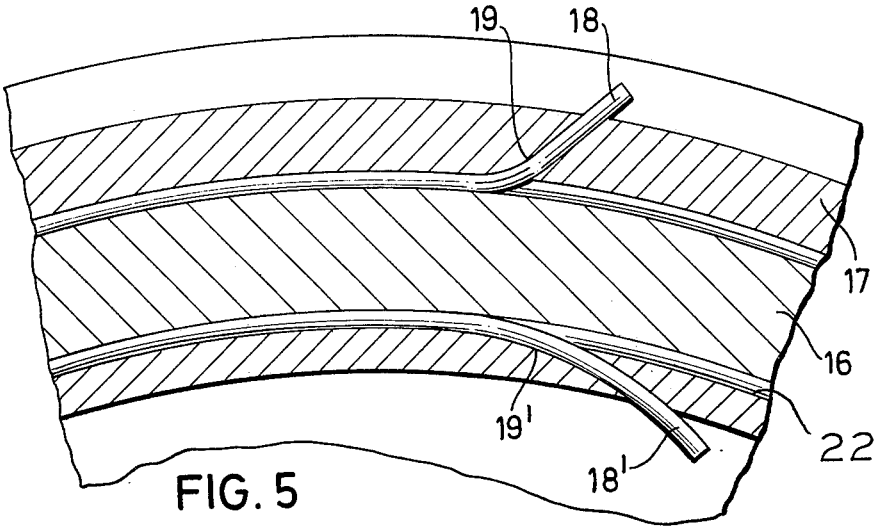
FIG. 5
FIG. 6
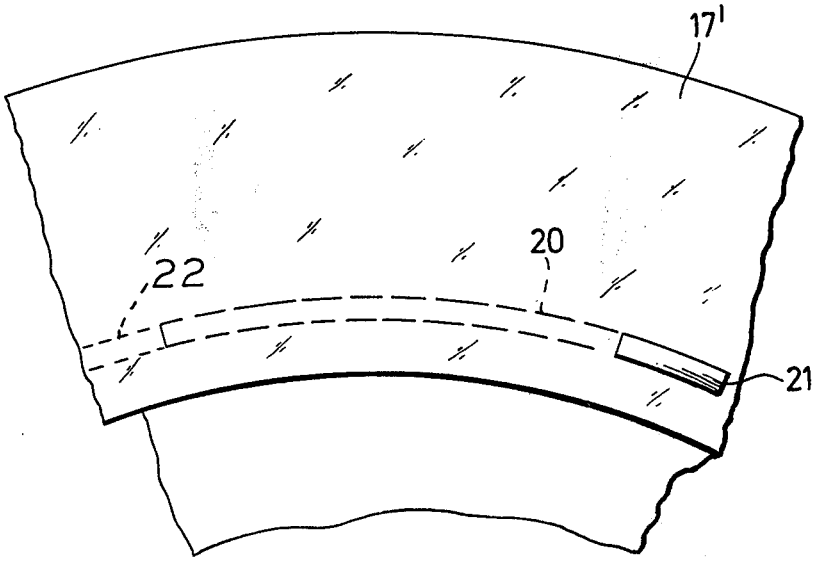

SEPARATOR WORM FEED AUGER AND WEAR PLATES

BACKGROUND OF THE INVENTION

The invention relates to a centrifugal separator for the continuous separation of a solids-liquid mixture which includes a rotatable chamber and a spiral rotatable advancing unit within the chamber. More particularly, the invention relates to an improvement in the advancing structure wherein a wear plate is mounted by an improved structural relationship on a carrier vane.

With the operation of centrifugal separating chambers of the types heretofore available having a spiral advancing unit therein, the spiral advancing unit or worm wears rapidly due to abrasion with the solids mixture that passes through the chamber. The advancing worms have been formed in various constructions to accommodate wear and to obtain as long a wearing life as possible to avoid the necessity of shut-downs and servicing and to insure continued satisfactory operation which cannot occur with too much wear. One manner in limiting the wear and increasing the operating life has been to provide the outer edge of the advancing worm with a wear-proof material, for example, such as stellite or ceramic. These wear plates have been aligned with one another, usually without joints, and have radially extending contact points which may be formed or cut to be flush or may be inclined or may be arranged to be in overlapping relationship. Generally, the wear plates have been welded to the spiral advancing worm, and in other cases they have been affixed with screws or bolts or otherwise welded or cemented in place. With these types of fastenings, when replacement or refinishing of the wear plates had to be accomplished, it could be done only with considerable difficulty and required considerable time for the introduction and exchange of new wear plates for the old. It has been found with many types of attachments such as the use of threaded fasteners that after a short period of operation, the threads become so foul or corroded that they are no longer operative, and the wear plates cannot be removed without some form of cutting or destruction of the threaded elements. It has also been found that where the plates are welded in place, the formation of cracks occur which makes continued operation unsatisfactory and, of course, weakens the construction. Wherein cementing material is used, it has been found to be inadequate in strength to hold the wear plates in place and difficult to remove when exchange is to take place.

It is accordingly an object of the present invention to provide an improved structural arrangement for the fastening of wear plates on spiral or advancing worms for separators wherein the wear plates are quickly and readily removed for replacement without substantial alteration or damage to the carrier worm.

A further object of the invention is to provide a carrier worm and wear plate assembly wherein the unit has a relatively long operating life and satisfactory and secure mounting or attachment remains during the operating life and until the wear plates have to be removed and replaced. It is a further object of the invention to provide a clamping arrangement wherein wear plates can be removed and reattached by an operator who does not require special training or talent and which does not require welding or cementing and wherein the securing means can be quickly removed and used for new wear plates.

A further object of the invention is to provide an improved advancing worm structure for a centrifugal separator wherein a plurality of wear plates may be mounted with one clamping piece unit.

Other objects, advantages and features, as well as equivalent structures, which are intended to be covered herein, will become more apparent with the teaching of the principles of the invention in connection with the disclosure of the preferred embodiments thereof in the following specification, claims and drawings, in which:

DRAWINGS

FIG. 2A is a fragmentary sectional view taken substantially along line A—A of FIG. 2;

FIGS. 4A and 4B are fragmentary sectional views taken respectively along lines A—A and B—B of FIG. 4; and FIGS. 5 and 6 are sectional views taken substantially along line V—V and VI—VI respectively in FIG. 2, each illustrating a different form of the invention.

DESCRIPTION

Figure 1:
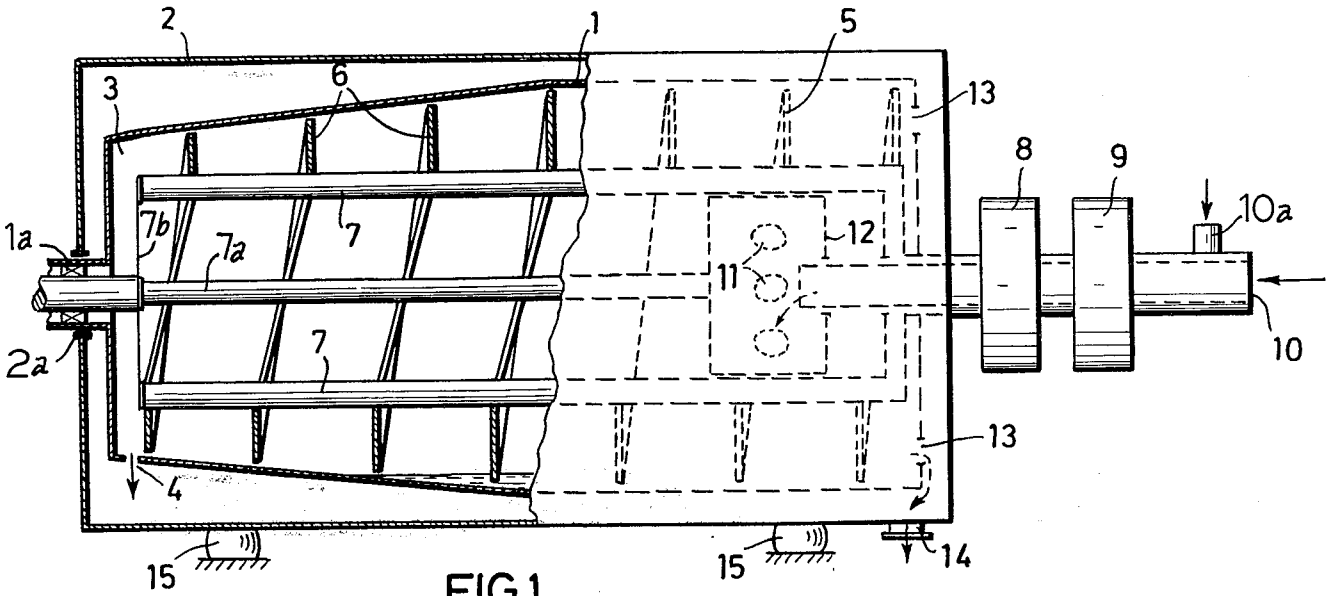
FIG. 1 is an elevational view, with a portion shown in section, of a centrifugal separator constructed and operating in accordance with the principles of the present invention.

The centrifugal separator shown in FIG. 1 has a rotatable centrifugal drum 1 rotatably mounted on support bearings on its ends such as 1*a* carried on a central shaft 7*a*. The drum 1 also rotates on outer supporting bearings 2*a* carried in an opening of an end wall of a housing 2. The rotatable drum 1 has an inner separation chamber 3 with an opening 4 at one end of the drum for discharge of the solids. The drum is slightly tapered to a smaller size toward the discharge end, and the solids pass into the housing 2.

Within the chamber 3 is the discharge worm 5 which carries a spirally shaped carrier vane 6. The vane 6 is mounted on four axially extending supporting elements 7 which are supported on radial arms 7*b* extending outwardly from the center rotating shaft 7*a*. The advancing worm 5 with its spirally shaped carrier vane 6 is rotated at one speed of rotation with the drum 1 rotated at a different speed of rotation.

At one end of the shaft 7*a* are drive assemblies 8 and 9. The drive assembly 8 is constructed to be mounted on a hub at the end of the rotatable drum 1 to be able to drive it in rotation. The drive assembly 9 is mounted at the end of the shaft 7*a* so as to be able to rotate the worm 5 in rotation. These drive assemblies 8 and 9 may take suitable forms as will be recognized by those versed in the art, such as being drive pulleys or gears driven by speed controlled power drive means.

The material to be separated, which is a solids-liquid mixture is fed in through a stationary pipe 10 which extends axially inwardly to discharge into a rotatable distributing chamber 12 having a circumferentially arranged row of holes 11 to permit the material to pass outwardly into the rotating chamber 1. In the front wall of the rotatable chamber 1 are openings 13 which provide for the discharge of the liquid from the chamber 1 with the liquid passing out through a conduit 14 connected to suitable piping for carrying the liquid away.

The housing 2 is supported on resilient supports which may be in the form of rubber mounts 15 to assimilate vibration of the unit. The pipe 10 for feeding the material into the unit has a lateral inlet 10*a* and an axial inlet for receipt of more than one material, and different arrangements for feeding the material to the separator may be provided as is known to those versed in the art.

Figure 2:
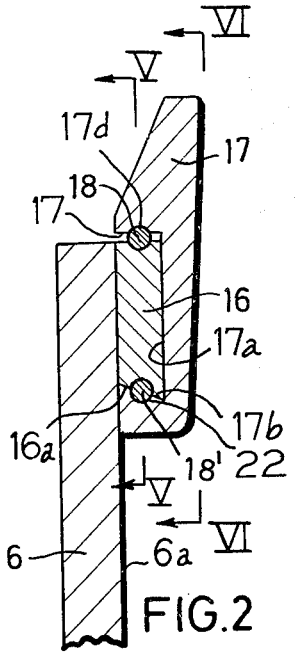
FIG. 2 is an enlarged fragmentary detailed sectional view showing the relationship between the wear plate and the carrier vane.
Figure 3:
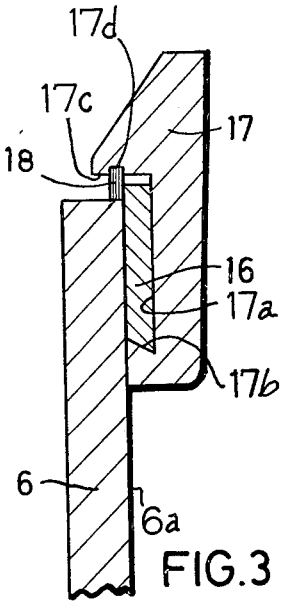
FIG. 3 is a fragmentary sectional view showing the relationship between the carrier vane and wear plate of a construction different than FIG. 2.
Figure 4:
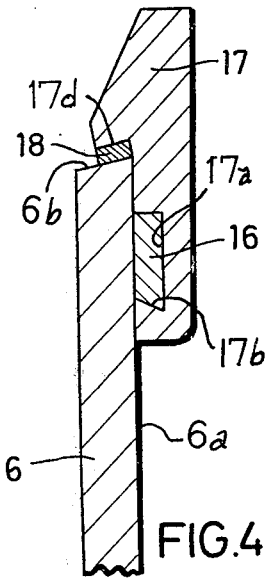
FIG. 4 is another detailed sectional view showing a further modified structure.

On the worm rotor is the endless carrier vane 6. Arcuate wear plates 17 are mounted in segments on the carrier vane with the wear plates preferably facing in the direction that the material is being moved in the chamber. As illustrated in FIGS. 2 through 4, the wear plates are mounted on the carrier vane by means of a mounting piece 16. Means are provided for securing the wear plate to the mounting piece so that the wear plate will not tilt on the carrier vane, and the mounting piece will be the principal source of support for the wear plate. The mounting piece is suitably secured, such as by welding, to the carrier vane, and the mounting piece has a plurality of circumferential separations as illustrated in the forms of FIGS. 2A and 4A and 4B.

As illustrated in FIGS. 2 and 2A, the wear plate has an arcuate axially facing channel 17*a*. The lower rim of the channel 17*b* is bevelled, and the lower rim of the mounting piece at 16*a* is matingly bevelled. With this arrangement, when the wear plate is pulled radially outwardly, the two surfaces 17*b* and 16*a* will firmly interlock, and the wear plate will be drawn axially snugly against the face 6*a* of the carrier vane.

For drawing the wear plate radially outwardly, it has an overhanging lip 17*c* which overhangs the upper edge of the wear plate. Concave grooves are provided in both the upper and lower edge of the mounting piece and upper and lower edge of the channel of the wear plate to receive circular locking pins 18 and 18'. These pins are wire-like material, and are driven tangentially, or in other words, circumferentially into place as shown in FIGS. 5 or 6.

In the arrangement of FIG. 3, the wear plate has a similar axially facing channel 17*a* with a lower bevelled locking surface 17*b*. In this arrangement the upper edge of the channel 17*a* is arranged so that an overhanging lip 17*c* of the wear plate overhangs far enough to extend over the carrier vane 6. A rectangular locking pin 18 is driven into place in a notch 17*d* in the overhanging lip 17*c*.

In the arrangement of FIG. 4, the wear plate has an axially facing channel 17*a* with its lower rim bevelled so as to lock firmly against the lower edge of the wear plate 16. The wear plate has an overhanging lip 17*d* which extends over the carrier vane. The upper edge 6*b* of the carrier vane is angled, as is the inner edge 17*c* of the overhanging lip 17*d* of the wear plate. With these faces parallel and angled, the securing member 18 will hold the wear plate in place drawing it snugly against the face 6*a* of the carrier vane. Thus, in each of the three arrangements, the carrier vane is firmly and securely mounted at two radially spaced locations which are essentially at the outer and inner edge of the wear plate. In the arrangement of FIG. 4, the securing element 18 may be in the form of a hardening plastic which is forced into the space such as an epoxy material.

As illustrated in FIG. 5, for inserting the locking pin material 18', an angular threading channel 19' extends through the wear plate in alignment with the groove 20 which receives the pin material. The round wire, or round rod, 18' is introduced into the opening 19 from below and driven into the opening so that it slides into the locking slot formed by the groove 20.

Similarly, the upper pin material 18 is driven into place through a threading channel 19 which extends downwardly into the wear plate. The threading channels 19 and 19' can be formed in one of the wear plates, and the pin material can be sufficiently long so that it locks adjacent wear plates. For removal of the wear plates, the pin material is grasped and pulled out through the channel. The pin material is a strong round wire or round rod and will follow the channel opening. In the case of a rectangular material, such as shown in FIGS. 3 and 4, the channel will be rectangular in shape.

FIG. 6 shows a modified form of wear plate 17' with a tangential opening 20 therein into which pin material 21 is inserted. The channel 20 extends at an angle through the face of the wear plate to be aligned with the groove 22. For aiding in inserting the locking pin material 18, 18' and 21, mechanical vibrators may be mounted on the clamping members, and the vibration will aid in easing the insertion of the locking pin members into place, and will ease with drawing them when the wear plates are to be changed.

Thus, it will be seen that I have provided a separator structure which meets the objectives and advantages above set forth and which provides a longer wearing, more secure unit than heretofore available, and one which permits ready and quick changing of the wear plates.

I claim as my invention:

1. In a centrifugal separator having a rotating chamber, a material advancing structure within the chamber comprising:

a spirally shaped carrier vane arranged coaxially within the chamber supported on a rotatable driving shaft;

a spirally shaped wear plate supported on the vane with an edge radially outwardly of the vane and a mounting face extending radially alongside of a radial face of the carrier vane;

a mounting piece secured to said mounting face of the carrier vane;

and mechanically releasable means securing said wear plate to the mounting piece so that the wear plate will not tilt on the carrier vane;

said securing means including a first locking surface on one of said carrier vane and mounting piece and a second locking surface on said wear plate, and a removable locking element between said surfaces with said locking element being removable for replacement of the wear plate.

2. In a centrifugal separator having a rotating chamber, a material advancing structure within the chamber in accordance with claim 1:

including an axially facing channel in said mounting face of the wear plate having a radial depth for fitting closely over said mounting piece with said locking element of said securing means positioned between the inner surface of said channel and said mounting piece on a radial facing edge of said mounting piece and said channel.

3. In a centrifugal separator having a rotating chamber, a material advancing structure within the chamber in accordance with claim 2:

wherein said locking element of the securing means is in the form of a cylindrical rod extending in a circumferential direction between said channel and said mounting piece.

4. In a centrifugal separator having a rotating chamber, a material advancing structure within the chamber in accordance with claim 2:

wherein said locking element of said securing means is in the form of a solidified plastic material.

5. In a centrifugal separator having a rotating chamber, a material advancing structure within the chamber in accordance with claim 2:

wherein said securing means includes a first locking element on the radial inner side of said mounting piece and includes a second locking element on the radial outer side of said mounting piece with each element securing the wear plate to the mounting piece.

6. In a centrifugal separator having a rotating chamber, a material advancing structure within the chamber in accordance with claim 1:

wherein said mounting face of the wear plate has an axially facing channel with the radial inner edge of the channel being bevelled and the radial inner edge of said mounting piece being coactingly bevelled to lock against the edge of the channel and said locking element of said securing means holding said wear plate outwardly in a radial direction for holding the radial inner surface of the mounting piece in locking engagement with said channel of the wear plate.

7. In a centrifugal separator having a rotating chamber, a material advancing structure within the chamber in accordance with claim 1:

wherein said wear plate has a channel fully receiving the mounting piece enclosing and protecting said mounting piece from an axial and radial direction with said mounting piece having an absence of surfaces exposed to the chamber.

8. In a centrifugal separator having a rotating chamber, a material advance structure within the chamber in accordance with claim 1:

wherein said securing means includes circumferentially spaced gaps in an overhanging portion of said wear plate providing circumferential access to said locking surfaces for insertion of said locking element.

9. In a centrifugal separator having a rotating chamber, a material advancing structure within the chamber in accordance with claim 1:

including an opening in said wear plate leading to said locking surfaces for insertion of the locking means.

10. In a centrifugal separator having a rotating chamber, a material advancing structure within the chamber in accordance with claim 9:

wherein said opening extends in a radial direction through the wear plate.

11. In a centrifugal separator having a rotating chamber, a material advancing structure within the chamber in accordance with claim 9:

wherein said opening extends in an axial direction through the wear plate.

* * * * *